US005673721A

United States Patent [19]

Alcocer

[11] Patent Number: 5,673,721

[45] Date of Patent: Oct. 7, 1997

[54] ELECTROMAGNETIC FLUID CONDITIONING APPARATUS AND METHOD

[76] Inventor: Charles F. Alcocer, 301 Constitution Dr., Maurice, La. 70555

[21] Appl. No.: 206,458

[22] Filed: Mar. 4, 1994

Related U.S. Application Data

[63] Continuation of Ser. No. 134,051, Oct. 12, 1993, abandoned.

[51] Int. Cl.[6] ..... F15C 1/04

[52] U.S. Cl. ..... 137/13; 137/827; 210/222

[58] Field of Search ..... 210/222; 137/13, 137/827

[56] References Cited

U.S. PATENT DOCUMENTS

| | | | |
|---|---|---|---|
| 4,216,800 | 8/1980 | Garnier et al. | 137/827 |
| 4,324,266 | 4/1982 | Garnier et al. | 137/827 |
| 5,052,491 | 10/1991 | Harms et al. | 137/13 |
| 5,074,998 | 12/1991 | De Baat Doelman | 210/97 |
| 5,113,890 | 5/1992 | Elizondo-Gonzalaz et al. | 137/13 |
| 5,171,431 | 12/1992 | Schulte | 210/222 |
| 5,269,916 | 12/1993 | Clair | 210/222 |

*Primary Examiner*—A. Michael Chambers
*Attorney, Agent, or Firm*—Alton W. Payne

[57] ABSTRACT

An electromagnetic fluid conditioning (EFC) apparatus and method to control paraffin and/or asphaltene is disclosed. Further, the present invention incorporates the discovery that the electric field must have specific characteristics to achieve the efficiency described herein. The invention disclosed is an apparatus and method for inducing a magnetic field parallel to the flow of fluid in the conduit at surface or downhole conditions and an electrical field orthogonal to the direction of the flow of fluid in the conductor. The EFC apparatus comprises a non-magnetic conduit having opposite ends and allowing a flow of product to go therethrough, an insulated coiled wire or winding in a magnetic enclosure within its opposite ends. The adjacent turns of the wire are electrically insulated from each other and the non-magnetic conduit. The winding is protected with an aluminum or stainless steel or other suitable non-magnetic material that encapsulates the wire and part of the non-magnetic conduit. The internal wall of the non-magnetic conduit is coated with a plastic film to insulate the non-magnetic conduit from the electrical field induced within the non-magnetic conduit of the magnetic field. The peripheral electrical devices are external. The peripheral electrical devices required are as follows: a mode selector switch (½ wave/full wave), a rectifier if DC current is desired, a voltage transformer if other voltage difference from 112 volts is required depending on the specific application.

16 Claims, 9 Drawing Sheets

ELECTROMAGNETIC FLUID CONDITIONING APPARATUS AND METHOD

This application is a continuation of Ser. No. 08/134,051 filed Oct. 12, 1993, now abandoned.

FIELD OF THE INVENTION

The present invention relates generally to an apparatus and method for the treatment of fluids by an electric field and a magnetic field. Specifically, the present invention relates to an electromagnetic fluid conditioning apparatus and method for preventing the build-up of, or reducing the natural deposition of, paraffin, asphaltene or the like in a flow line and/or other substances susceptible to an electric field and a magnetic field.

BACKGROUND OF THE INVENTION

Magnetic fields can affect the physical properties of water. Physical properties such as viscosity, surface tension, osmotic pressure, Ph-value are a few of the physical properties which have been reported affected by engaging water with magnetic fields. Similarly, there has always been a concern for the treatment of fluids having contaminants. Fluids having contaminants or components such as paraffin, asphaltene or the like are required to be treated so that the fluid provides a more useful purpose. Alternately, the reason for treating a fluid may be to increase the flow rate, optimize a physical parameter of the fluid or the like.

It is especially desirable to reduce the build-up of or components such as paraffin, asphaltene or the like, as well as contaminants, in association with the transfer of fluids. The build-up of paraffin, asphaltene or contaminants cause fluid flow to decrease which ultimately can result in a system being shut down for cleaning or repair.

In such situations the efficacy of the treatment of fluids using magnetic fields is determined by the strength of the applicable magnetic field, the frequency associated with the field, the strength of the magnetic fields, and possible pulsation characteristics.

The effect of a magnetic field on aggregates to control solidification of metals have been reviewed in technical Literature. Lad'yandy, V. I., Novokhatskly, I. A., Koshukhar', I. Ya., pogorelove, A. I., Ustyuk I. I. (Sverdlovsk): "Influence of Magnetic Field on the Viscosity and Structure of Liquid Metals" (1980) reported an experimental study of influence of magnetic fields on the viscosity and structure of liquid metals. Lad'yandy, et al., reported a substantial reduction in kinematic viscosity differences for metallic liquid using transverse and longitudinal magnetic fields. The mechanism of the observed effect is satisfactorily explained with allowance for structural micro irregularity in liquid metal. Lad'yandy, et al., stated that: "The oriented arrangement of clusters in magnetic field significantly influences numerous processes in liquid metals, in particular solidification processes. Within the frame work of the quasi polycrystalline model, the process of liquid solidification can be considered to comprise the following successive stages: liquid cluster→crystal embryo→solid. It is suppose that the crystal embryo forms by association of several clusters with similar lattice orientation until it reaches a certain size. The crystal forms by growth of the embryo, primarily by attachment to it of other clusters which are also in crystallographic alignment with the growing crest. In this case, embryos formed from clusters durring the pre-solidification period are preferentially oriented along the magnetic liners of force of the liquid. The proposed mechanism of influence of magnetic field on processes of crystal nucleation and growth are in good agreement with available test results on the solidification of molten Al—Ni, Cd—Zn, Bi—Cd and Al—Cu in constant magnetic field."

Some crude off contains adequate concentration of iron to have a magnetic susceptibility. The ferro-magnetic fluid hypothesis is based on crude oil having obtained iron from the earth. The iron content gives magnetic susceptibility to the crude oil. Ferrofluids are stable colloidal suspensions of sub-domain sized ferrite particles dispersed in a liquid medium by a suitable surfactant agent. Ferrofluids have been successfully prepared using water, hydrocarbons, esters, diastase, fluorocarbons, and even liquid mercury. Two applications showing considerable promise are ferrofluid rotary shaft seals and scrap metal separators. Rotary shaft seals have been commercially available for several years. Magnetic susceptibilities are required and as laboratory analysis to determine the content of iron. For instance, the paraffin with ferromagnetic particles are mainly paramagnetic. Fossil water, the formation water associated with crude off in the reservoir, normally contains iron in the range of 10–30 ppm.

The technical literature reports using magnetic fluids to control suspension stability by using magnetic saturation between 20 and 200 gausses. For example, Wooding, A., et al.: *Proteins and Carbohydrates as Alternatives Surfactants for the Preparation of Stable Magnetic Fluids,* University of Durham, England, Magnetic Master application. Conference on September 1987 reports one-stage preparation of stable aqueous magnetic fluids, whereby colloidal $F_3O_4$ particles are dispersed using naturally occurring polymers and their derivatives (e.g., gelatin, polygalacturonic acid, carboxymethyl-cellulose and succinylated gelatin) as surfactant materials. Low-toxicity materials have been used to permit possible medical use of the fluids. Using a variety of surfactant concentrations at the time of particle formation, control of particle size has been achieved, and particles as small as 3.0 nm in diameter obtained. Stable fluids with up to 6% $F_3O_4$ content can be produced.

Further, Jones, T. B. and Krueger, D. A., *An Experimental and Theoretical Investigation of the Magnetization Properties and Basic Electromagnetic and Electromechanics of Ferrofluids* reported basic research on magnetization properties and the build response of ferrofluids to magnetic fields. From the fluid mechanical point of view, ferrofluids are a typical because they can interact with a magnetic field to produce a controllable body force on the fluid, a body force significant with respect to terrestrial gravity. From the basic physical point of view, ferrofluids are interesting because of the mechanisms which are involved in the transformation of the forces on individual ferrite particles to the bulk of the liquid carrier. The Jones, et al., research program was divided into studies of the magnetization properties, and the electromechanics and applications.

Also, Belorai, Ya., et al.: *Application of Nuclear Magnetic and Electron Paramagnetic Resonance to Control Structural Changes During Pressure and Heat Treatments of Crudes:* Izvestiya Xysshikh, Gaz. no 1, July 1993. p. 51–55, from the Scientific Research Institute of Nuclear Geophysics and Geochemistry of Russia conducted research with non-newtonian crude oil. They reported research conducted using crude from the Uzen deposit with non-newtonial properties. The experiments were performed both on samples of crude and model specimens (mechanical solutions of paraffin, resins, and asphaltene in diesel fuel.) Belorai, et al., determine that Uzen crude oil was paramagnetic with a high content of paraffin.

Rheological parameters of the investigated model specimens and oils were determined on the "Rheotest"-type viscosimeter. They studied baroprocess and thermoprocess. It has been shown that both types of processing yield a considerable decrease in the shear stress. Based on the nuclear magnetic and electron paramagnetic resonance, pressure and heat treatment have a similar effect on the structure and rheological characteristics of oils. The shear stress reduction implies a considerable reduction in the viscocity of crude oil. Also, the authors considered that the effect on structure was significant.

Kha la falla, Aanaa and Reimers, George: *A Method for Clarifying Slimes,* Department of the Interior, Washington, D.C., August (1980) reported a method for clarifying slimes. The method is based upon the discovery that the unique flocculate described was useful in slime clarification. This discovery is based upon the further discoveries that the surfactant in this flocculate bridges the slime particles electrostatically to the colloidal magnetic particles in this flocculate, and serves to stabilize the magnetic colloid. In the described method, a negatively charged slime was treated with an anima-stabilized magnetic colloid that has a net positive charge. The amine stabilizing agent is a n-C10 to n-C15 aliphatic amine. A preferred amine is dodecylamine. A magnetic colloid containing dodecylamine in an amount that is approximately 25% of the magnetic particles, on a weight basis, and containing about 20w/v % of the magnetic particles, which have a size ranging from about 50 to 100 Å, has a saturation magnetization of about 200 gausses. This colloid becomes unstable and flocculates when diluted to a magnetization less than about 1 to 3 gausses.

Parsonage, P.: *Particle Interactions in Colloidal Suspensions,* Warren Spring Lab., Stevenage, England 1987 has presented a review of the mechanisms of particle introduction in colloidal suspensions. Effects due to born repulsion, van der Waals forces, electrical interactions, hydration, structural and steric effects, hydrophobic effects and magnetic interactions were considered. A usable set of equations was presented for describing each of these effects in systems of identical spherical particles. Use of these equations allows prediction and interpretation of suspension behavior relevant to coagulation, flotation, filtration and rheological control. Some examples of the variation of interaction energy with particle separation were given to illustrate the influence of changes in the surface magnetic and solution properties.

Of particular interest for the present invention is the formation of paraffin and asphaltene solutes in off products. It is a common known problem that the build-up of paraffin and asphaltene solutes in production lines, flow lines and pipe lines is a major problem. Many fluids can be, and are, chemically treated to prevent build-up and unwanted formations. Also, it is not unusual for the use of heating or cooling to reduce unwanted formations. Lastly, mechanical means are adapted to remove such formations, for example, scraping and grinding. Thus, there is a great need for reducing the unwanted build-up by means other than chemicals, thermal methods, mechanical methods and inefficient electromagnetic methods.

It is, therefore, a feature of the present invention to provide an electromagnetic fluid conditioning apparatus and method which inhibits the build-up of, and the formation of, crystals and solids associated with pipelines and other related production equipment.

A feature of the present invention is to provide an electromagnetic fluid conditioning apparatus and method that increases the solubility of paraffin, asphaltene or other substances of interest in crude oil.

Another feature of the present invention is to provide an electromagnetic fluid conditioning apparatus and method that decreases the cloud point, pour point, viscosity and deposition of paraffin, asphaltene, and other similarly related compounds or substances of interest.

Yet another feature of the present invention is to provide an electromagnetic fluid conditioning apparatus and method that will increase the production and cut the cost of controlling paraffin and asphaltene on pumps, pump rods, tubing and production equipment, and pipelines.

Still another feature of the present invention is to provide an electromagnetic fluid conditioning apparatus and method that controls scaling.

Another feature of the present invention is to provide an electromagnetic fluid conditioning apparatus and method for removing existing depositions of paraffin and asphaltene.

Yet another feature of the present invention is to provide an electromagnetic fluid conditioning apparatus and method which eliminates or greatly reduces the need for using hot oil techniques, pigging, chemicals and scraping in association with oil production, flow line and pipe line maintenance.

Still another feature of the present invention is to provide an electromagnetic fluid conditioning apparatus and method that eliminates the need to continuously monitor, feed, adjust, service, handle or test to maintain proper well chemistry.

Another feature of the present invention is to provide an electromagnetic fluid conditioning apparatus and method that is fully automated, can operate continuously, and requires no maintenance.

Yet another feature of the present invention is to provide an electromagnetic fluid conditioning apparatus and method that reduces reservoir damage and extends well life.

Yet another feature of the present invention is to provide an electromagnetic fluid conditioning apparatus and method that facilitates water and off separation in dehydration units.

Yet still another feature of the present invention is to provide an electromagnetic fluid conditioning apparatus and method that is non-polluting and complies with all state, federal and international environmental laws.

Yet further, an additional feature of the present invention is to provide an electromagnetic fluid conditioning apparatus and method according to a specific mathematical design such that the designing parameters are fully appreciated.

Yet another feature of the present invention is to provide an electromagnetic fluid conditioning apparatus and method which has significantly increased electrical fields for increasing the effectiveness to control paraffin or asphaltene deposition.

Yet another feature of the present invention is to provide an electromagnetic fluid conditioning apparatus and method that uses a vibrating magnetic field.

Yet still further, another feature of the present invention is to provide an electromagnetic fluid conditioning apparatus and method that combines a vibrating magnetic field and a vibrating electric field.

Yet still another feature of the present invention is to provide an electromagnetic fluid conditioning apparatus and method that significantly decreases viscosity of the fluid such that solutes in the fluid are maintained in solution.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

To achieve the foregoing objects, features, and advantages and in accordance with the purpose of the invention as embodied and broadly described herein, an electromagnetic fluid conditioning apparatus and method is provided.

In one embodiment, a method for the treatment of fluids or solutions is provided. The fluids are effected by electric or magnetic fields, such as, for example, paraffin, asphaltene and any other fluids similarly affected. The method comprises the steps of: (a) passing the fluid through a nonmagnetic conduit having a central axis, (b) generating a magnetic field of sufficient intensity to effect the fluid, and given that the fluid has magnetic propensities, creating a ferromagnetic fluid, (c) inducing an electric field in association with the magnetic field such that the magnetic field is parallel to the flow of fluid in the conduit and the induced electric field is orthogonal to the direction of the flow of fluid in the conduit, (d) vibrating the magnetic field and the electric field to a sufficient intensity so as to control the nucleation phenomena of the molecules such that aggregation is inhibited and the molecules remain in solution, and (e) engaging the fluid with the combined effect of the electric field and the magnetic field such that the electric field is zero at the central axis of the conduit and increases proportionally therefrom for reducing or preventing sedimentation. The method for the treatment of fluids or solutions can further include the step of insulating the conduit from direct contact with the electric field. The step of vibrating the magnetic field and the electric field can, for example, include using a high frequency AC current or a pulsed DC current. The method of the present invention provides for precise calculation of the magnetic field, B, with sufficient intensity to effect the fluid by calculating the intensity from $$B=\frac{\mu_0 I N}{L}.$$

In another embodiment, an electromagnetic fluid conditioning apparatus is provided. The apparatus is also for the treatment of fluids or solutions comprising molecules which fluids are effected by electric or magnetic fields, such as, for example, paraffin, asphaltene and any other fluids similarly affected. The apparatus comprises generally a non-magnetic conduit, means for generating a magnetic field such that an electric field is induced in association with the magnetic field, and means for vibrating the magnetic field and the electric field to a sufficient intensity for controlling the nucleation phenomena of the molecules such that aggregation is inhibited and the molecules remain in solution.

More particularly, the electromagnetic fluid conditioning apparatus of the present invention comprises (a) a non-magnetic conduit having a first end and a second end, the conduit having an unobstructed passage for receiving and passing the fluid, (b) means for generating a magnetic field, and given that the fluid has magnetic susceptibility, the magnetic field creates a ferro-magnetic fluid, such that an electric field is induced in association with the magnetic field whereby the magnetic field is parallel to the flow of fluid in the conduit and the induced electric field is orthogonal to the direction of the flow of fluid in the conduit, and (c) means for vibrating the magnetic field and the electric field to a sufficient intensity for controlling the nucleation phenomena of the molecules such that aggregation is inhibited and the molecules remain in solution. The vibrating magnetic field and electric field are engaged with the fluid. The electric field is zero at the central axis of the conduit and increases proportionally therefrom. The means for generating a magnetic field can be, for example, a coiled wire wrapped around the conduit. The coiled wire is insulated with respect to each turn of the coil. Further, the coiled wire has a winding length, L, and a diameter, D, such $0.1 \leqq L/D \leqq 10{,}000$. The apparatus of the present invention can also include a non-magnetic housing for encapsulating the coiled wire. An adjacent portion of the conduit can also be covered by the housing. The means for generating a magnetic field, B, of sufficient intensity to effect the fluid can be fabricated by calculating the intensity from $$B=\frac{\mu_0 I N}{L}.$$

An insulator is provided for preventing the direct contact of the fluid with the conduit. Vibrating the magnetic field and the electric field can be accomplished by, for example, using a high frequency AC current or a pulsed DC current.

The electromagnetic fluid conditioning apparatus treats fluids such as paraffin, asphaltene or other substances susceptible to the particular electromagnetic effect taught by the present invention. Another embodiment of the apparatus comprises a non-magnetic conduit having a first end and a second end. The conduit defines an unobstructed passage between the first end and the second end for receiving and passing therethrough the fluid. A device generates a magnetic field such that an electric field is induced in association with the magnetic field. Another device is provided for vibrating the magnetic field and the electric field to a sufficient intensity for controlling the nucleation phenomena of the molecules such that aggregation is inhibited and the molecules remain in solution. When the vibrating magnetic field and electric field are engaged with the fluid, the combined effect of the electric field and the magnetic field provides that the electric field is zero at the central axis of the conduit and increases proportionally therefrom thereby reducing or preventing sedimentation.

BRIEF DESCRIPTION OF THE DRAWINGS

The accompanying drawings which are incorporated in and constitute a part of the specification, illustrate a preferred embodiment of the invention and together with the general description of the invention given above and the detailed description of the preferred embodiment given below, serve to explain the principles of the invention.

Figure 1:
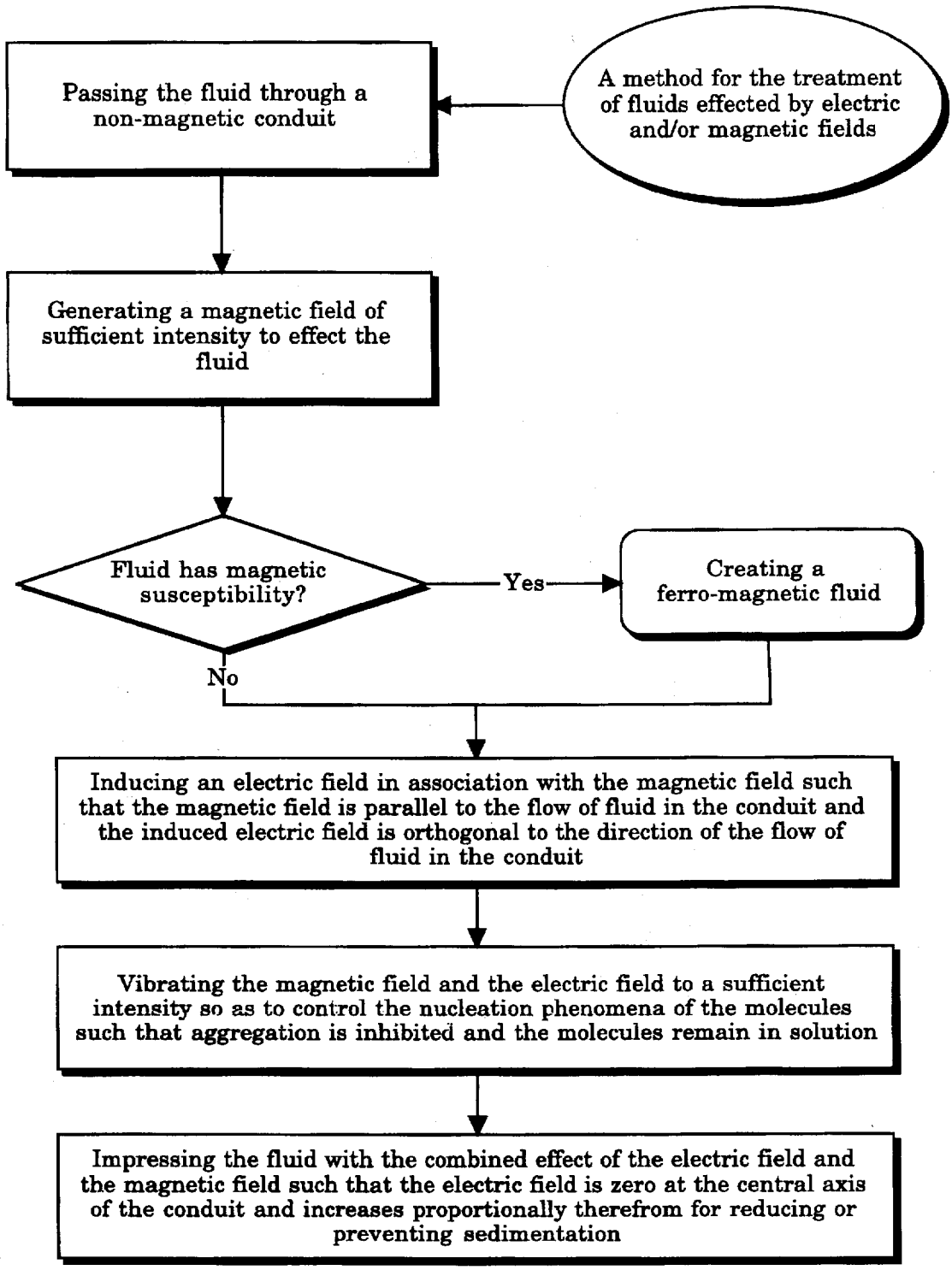
FIG. 1 is a flow diagram illustrating the method of the present invention.

The above general description and the following detailed description are merely illustrative of the generic invention, and additional modes, advantages, and particulars of this invention will be readily suggested to those skilled in the art without departing from the spirit and scope of the invention.

DETAILED DESCRIPTION OF THE PREFERRED EMBODIMENTS

Reference will now be made in detail to the present preferred embodiments of the invention as described in the accompanying drawings.

Deposition of paraffin, asphaltene or any other substance susceptible to the effect of the vibrating magnetic and electric fields provided by the present invention is a consequence of several mechanisms that transport both dissolved and precipitated wax residue laterally. When oil is cooling, a concentration gradient leads to transport by molecular diffusion with subsequent precipitation and deposition occurring at the wall of the conduit. In addition, small particles of previously precipitated wax can be transported laterally by Brownian diffusion and shear dispersion.

A small fraction of crystals that are being carried along in the bulk oil can be thus transported laterally and incorporated into immobile deposit. The total immobile deposit consists of approximately 14 to 17 percent solid phase in a porous structure with the pore structure being filled with liquid oil. The deposition occurs when the oil is below the cloud point temperature. See, for example, Burger, E. D., et al., "Studies of Wax Deposition in the Trans Alaska Pipeline" J. P. Tech. (June 1981) 1075–86.

Total deposition rates can be described by equation (1) as follows:

$$w_t = p_r A D_m \frac{dC}{dt} \quad \frac{dt}{dy} = k^* c_w^* \gamma A \qquad (1).$$

The diffusion coefficient, $D_m$, can be determined by using, for example, the Wilke and Chang experimental correlation's for diffusion coefficients. See, Wilke, C. R. and Chang, Pin: "Correlation of Diffusion Coefficients in Dilute Solutions," *A.I.Ch.E.J* (June 1955) 1 (2) 264–270. The Wilke and Chang diffusion coefficients are applicable for a wide variety of solute-solvent systems. Thus, the diffusion coefficient can be defined by equation (2), $$D_m = 7.4 \times 10^{-9} \frac{T_a(\epsilon M)^{1/2}}{\mu v^{0.6}} \qquad (2).$$

where dC/dt is the solubility coefficient of the paraffin in the oil and dt/dy is the radial temperature gradient to the wall. The radial temperature gradient can be determined by heat transfer analysis.

For Equations (1) and (2), the parameter are defined as follows:

A=Surface area available for deposition
C=Volume fraction concentration of wax in solution
$C^*_w$=Volume fraction concentration of wax out of solution at the wall.
$D_m$=Molecular diffusion coefficient
k*=Deposition rate constant
K'=Viscosity power law parameter for pseudo-plastic fluid
$K_1$=Dispersion Coefficient
L=Pipe length
M=Solvent molecular weight
N=Avogadro's number
N'=Viscosity power law parameter for pseudo-plastic fluid
T=Temperature
$T_a$=Absolute temperature
V=Solute molecular volume
$W_t$=total rate of solid deposition
y=Radial direction
γ=Oil shear rate at wall
ε=Association parameter
$p_r$=Waxy residue density
μ=Absolute viscosity Of interest to the present invention is polarization at molecular level. Polarization at the molecular level is described as physiosorption hypothesis. Physiosorption hypothesis is stated as follows:

The electromagnetic field generated by the present invention could polarize molecules within the dielectric medium. Large molecules such as paraffin and asphaltene have a relatively large polarizability and are therefore particularly sensitive to the electromagnetic field.

The large paraffin and asphaltene molecules are normally randomly oriented and have a strong tendency to precipitate and bond to a solid structure such as the wall of the pipe. When the electromagnetic field is applied, the most polarizable molecules will align themselves along the field such that molecular polarization results. This effect reduces the strength of the physiosorption interaction between the molecules and the walls of the pipe. The sticking coefficient of the molecules is thereby reduced preventing sedimentation. This process is explained as physiosorption.

The polarization at the molecular level, if any, is not a permanent effect. Thus, the effect of reducing sedimentation is lost immediately after the fluids leave a polarization unit. A high intensity magnetic field is required to produce molecular polarization. To control paraffin, asphaltene or the like in crude oil requires the control of the growth of the crystalline formation associated with paraffin, asphaltene or other substances. Molecular polarization fails to address the growth of crystal in paraffin. The alignment of paraffin molecules by the magnetic field and effect of the physiosorption interaction among molecules and between paraffin molecules and the walls of conduit is not sufficient. Thus, the molecular polarization fails to explain the inhibition of paraffin: crystals in the colloidal suspensions. The tendency to create center of conglomerations by physiosorption, in the colloidal suspension, will help crystals to reach a critical size and will promote deposition. All deposition mechanisms are magnified by increasing deposition with increasing crystal size. Changing the sticking coefficient of the molecules is not going to prevent deposition. A more reasonable hypothesis that explain the effect of an electric and magnetic field in interrupting the natural mechanism of crystal growth will be more suitable to explain the phenomenon controlling deposition in paraffin and/or asphaltene. The major drawback of this hypothesis is that the polarization at molecular level, if any, is a non-permanent effect and it should be lost immediately after the fluid leaves the polarization unit. Just alignment will not prevent paraffin or asphaltene from depositing.

The effect of the present invention on controlling paraffin deposition is based on aggregate/disaggregate hypothesis individually or combined with ferrofluid hypothesis. The aggregate and ferrofluid theories are proven and well developed theories in physical chemistry and chemistry. Nowadays these theories have a great range of applications in science and technology. The aggregate/disaggregate and ferrofluid theories are considered hypothesis in paraffin and/or asphaltene deposition control in crude oils. It is believed that the controlling effect of paraffin and or alphaltenes can be explained by aggregate hypothesis and ferrofluid hypothesis, individually or combined.

The Aggregate/Disaggregate Hypothesis states as follows: when paraffin and/or asphaltene colloidal suspension under dynamic conditions are exposed to a combined effect of electrical and magnetic fields of adequate intensity and vibration, the aggregate size is reduced. A critical mass is never reached and paraffin crystals are not formed. In principle, the electromagnetic field affects the nucleation phenomena taking place with the crude oil by disturbing the crystal centers formation. When the formation of the crystal centers is disturbed the crystallization process is prevented. The first three measurable consequences, according this hypothesis, to be detected in a dynamic fluid exposed to an electromagnetic fields (magnetic and electric) are: (1) a significant reduction in shear stress that will result in an instantaneous reduction of viscosity (absolute and kinematic), (2) no presence of paraffin, asphaltene or similar crystals in static fluid, and (3) colloidal stability under dynamic conditions. Field test results show an increase in production, and flow rate, with no deposition of paraffin, asphaltene or similar substance. The increase of production can be explained by viscosity reduction due to reduction of shear stress in the fluid. Colloidal stability also has been shown in field tests.

Precipitation of particles of paraffin, asphaltene or similar substances requires that the particles meet their real critical crystal size. The present invention vibrates the electric and the magnetic fields at a frequency which maintains the particles below the critical size. The vibrating fields breaks up the particles or aggregate of paraffin, asphaltene or similar substances so they do not reach critical mass and consequently the particles do not produce deposition. This concept is concerned with molecular mass. It has been found that by using a combined effect or electrical and magnetic fields with adequate intensity, unique results can be achieved. The nucleation phenomena can be controlled. By applying the present invention there is no driving force, no starting point where small crystal to form and precipitate. The aggregate size is reduced. With a lower aggregate size, the critical mass is not achieved and crystals are not formed. Vibrating the magnetic field and electrical field enhances this process.

To break up an aggregate of paraffin or asphaltene or any other substance susceptible to the process of the present invention, a magnetic field, and an electric field, are required. Using electromagnetic fields to break up an aggregate is the same principle as that of the shear viscosity or shear thinning and is effective under shear dispersion. However, as it sets for a while, it will aggregate again. Aggregate solution studies are very important area of research in physical chemistry. The aggregate concept is used extensively in chemistry and physical chemistry to control the stability of a variety of different solutions, specially with respect to the stability of polymer solutions.

The physical basis for the electromagnetic fluid conditioning apparatus and method of the present invention can be derived from the contribution to the magnetic field made by an element of current at location K (See FIG. 2) that is given by:

$$\partial H = \frac{I\partial L \sin\phi}{4\pi r^2} \quad (3).$$

for circular current Ø=90, thus $$\partial H = \frac{I\partial L}{4\pi r^2} \quad (4).$$

K is on the ads, the r is the same for all elements, then the total magnetic field is given by $$H = \int \partial H \sin\phi \quad (5).$$

$$r\sin\phi = r_1 \quad (6).$$

$$H = \frac{I r_1^2}{2r^3} \quad (7).$$

And $$r = r_1^2 + z^2 \quad (8).$$

Finally:

$$H = I\frac{r_1^2}{2(r_1^2 + z^2)^{3/2}} \quad (9).$$

Figure 2:
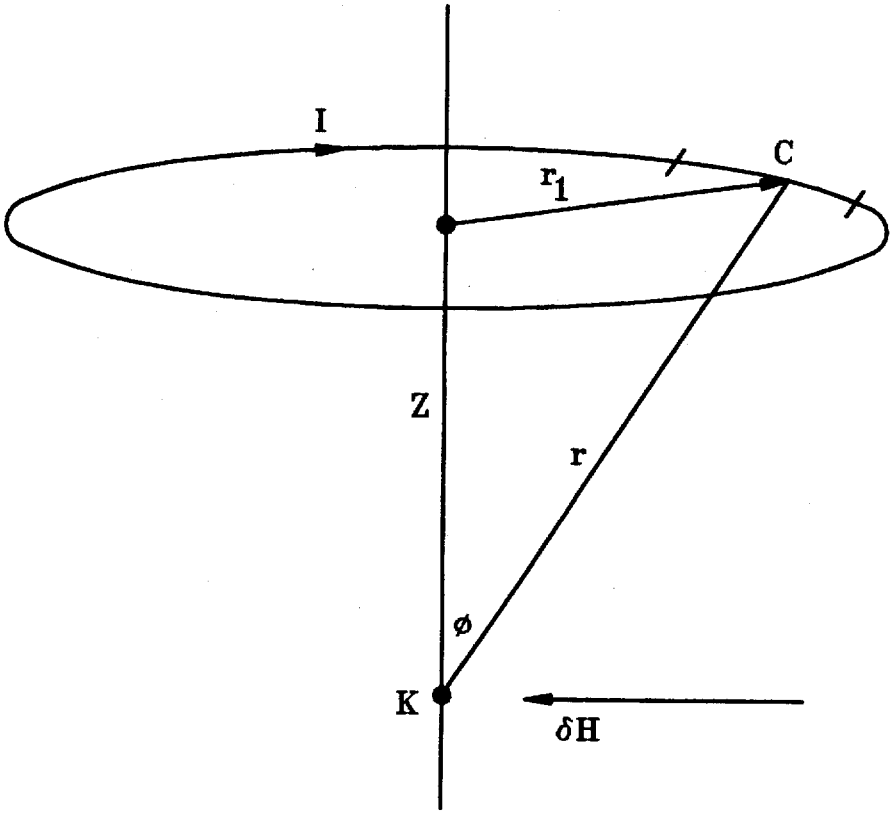
FIG. 2 illustrates the physical relationship of the magnetic field on the axis of a circular current as taught by the present invention.

The designing equation for the EFC apparatus of the present invention can be built up from a set of coils each like the one schematically illustrated in FIG. 2.

If the current per unit length of the apparatus is i. Then the contribution to the field H along the axis of the unit can be obtained from equation (9).

$$\delta H = \frac{i dz r_1^2}{2(r_1^2 + z^2)^{3/2}} \quad (10).$$

where $$r_1 = z\tan\phi \quad (11).$$

Then $$\delta z = -r_1^{csc2\phi\delta\phi} \quad (12).$$

$$\delta z = \frac{i r_1^3 csc^2\phi\partial\phi}{z r_1^3 csc^3\phi} \quad (13).$$

$$\delta z = -\frac{i}{z}\sin\phi\delta\phi \quad (14).$$

$$H = \frac{i}{2}(\cos\alpha_1 - \cos\alpha_2) \quad (15).$$

If the winding turns is N and the current is I',

Then $$i=\frac{H}{L}\,I' \quad (16).$$

Substituting $$H=\frac{I'H}{2L}\,(\cos\alpha_1-\cos\alpha_2) \quad (17).$$

Since the electromagnetic fluid conditioning apparatus of the present invention is long with respect to the diameter, the following equations apply:

$$\cos\alpha_1 = 1 \text{ and } \cos\alpha_2 = -1 \quad (18).$$

Simplifying $$H=I\frac{N}{L} \quad (19).$$

Figure 3:
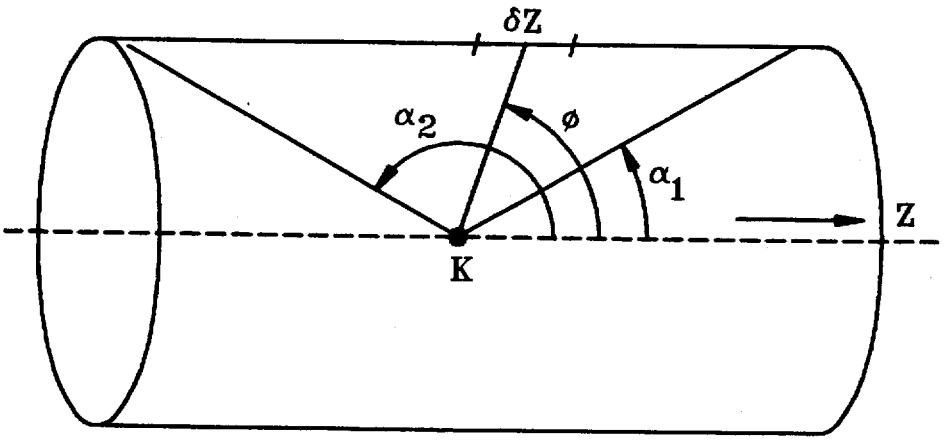
FIG. 3 illustrates a magnetic field on the axis of an elongated cylindrical embodiment of the apparatus of the present invention.

FIG. 3 illustrates mathematically the combination of a plurality of magnetic fields, one of which is illustrated in FIG. 2.

Finally, the magnetic flux density, B, in tesla (T) is given by $$B=\mu_o H, \quad (20).$$

The final designing equation is expressed as follows:

$$B=\frac{\mu_o I'N}{L} \quad (21).$$

where:

H=Magnetic field strength ampere/meter (A/M)
B=Magnetic flux density, tesla
I'=Current intensity, amperes
i=Current Intensity in an element
L=Winding length, meter
r=Distance to point K from circular current
$r_1$=Circular current radius
z=Direction parallel to the axis
$\mu_o$=Permeability, W/AM
N=Winding turns.

Figure 4:
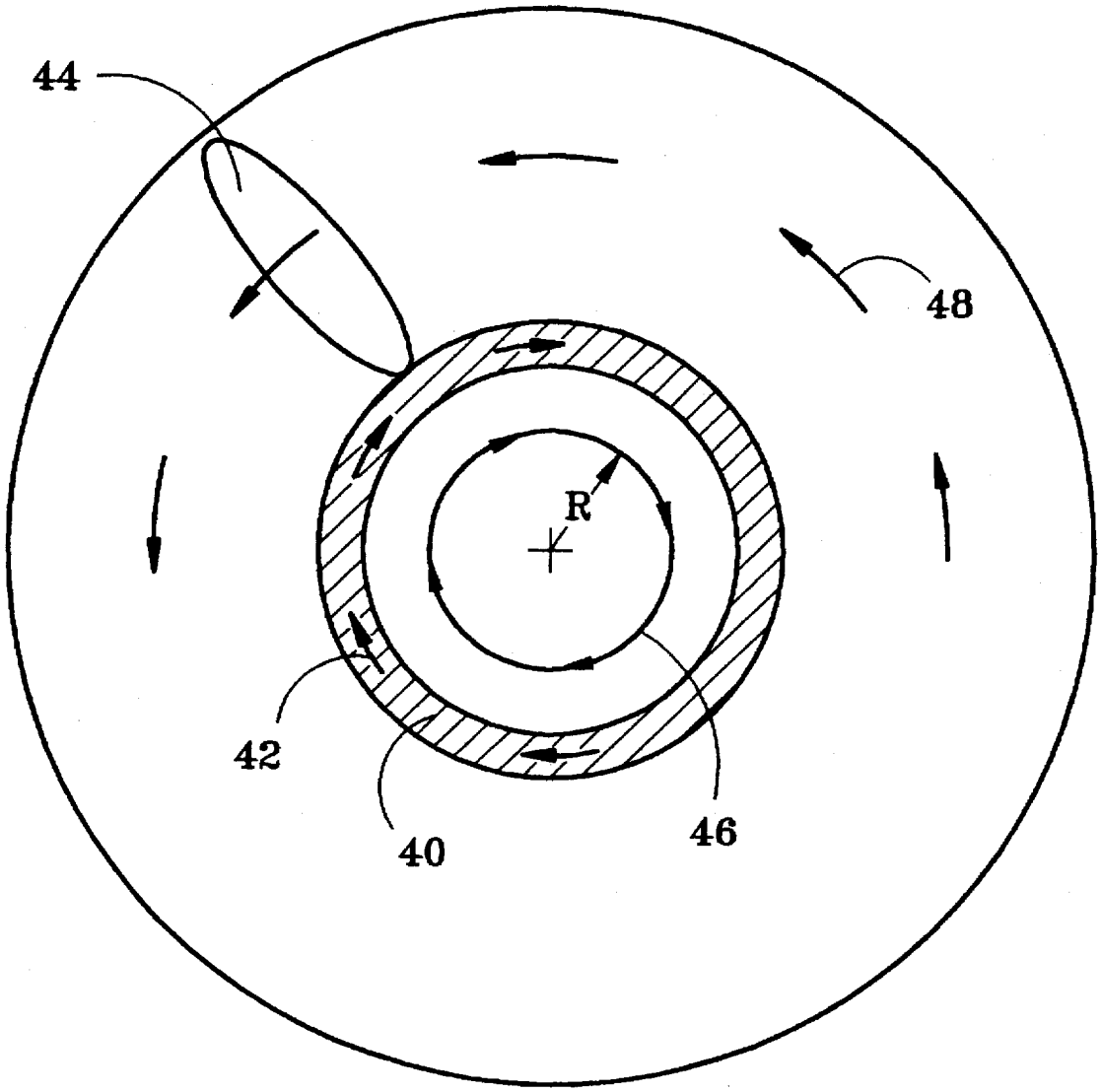
FIG. 4 is a cross-section of a cylindrical apparatus as practiced by the present invention illustrating the electrical field inside the pipe.

FIG. 4 schematicly illustrates the cross section of one preferred embodiment of an electromagnetic fluid conditioning apparatus of the present invention. A pipe 40 cross-section is illustrated having an induced current 42. The pipe 40 cross-section is surrounded by an area 44 having coil wire. The interior of the pipe illustrates a component 46 of an electric field at a rsdius, R. An increase in coil current is illustrated by the continuous arrows 48. With coil current 48 increasing counter clockwise, a circular electric field 46 is produced in the clockwise direction.

With the currents varying as a sine wave so the magnetic field in the conduit varies as a sine wave $B(t)=B_{max}\sin wt$. The flux in the circle with radius R is $\phi(t)=\pi R^2 B_{max}\sin(wt)$, since the magnetic field is very close to the same value anywhere in the cross sectional area of the conduit. The voltage in a turn around the electric field circle is described by the following equations:

$$\frac{d\phi(t)}{dt}=W\pi R^2 B_{max}\cos wt=\oint E.dl=2\pi R E_{max}\cos wt$$

$$E_{max}=\frac{WRB_{max}}{2}$$

$$E(t)=E_{max}\cos wt$$

As an example, let $B_{max}$=0.1 telsa, w=2π60 rad/sec, R=0.0254 meter, then $E_{max}$=0.479 volt/meter.

Figure 5:
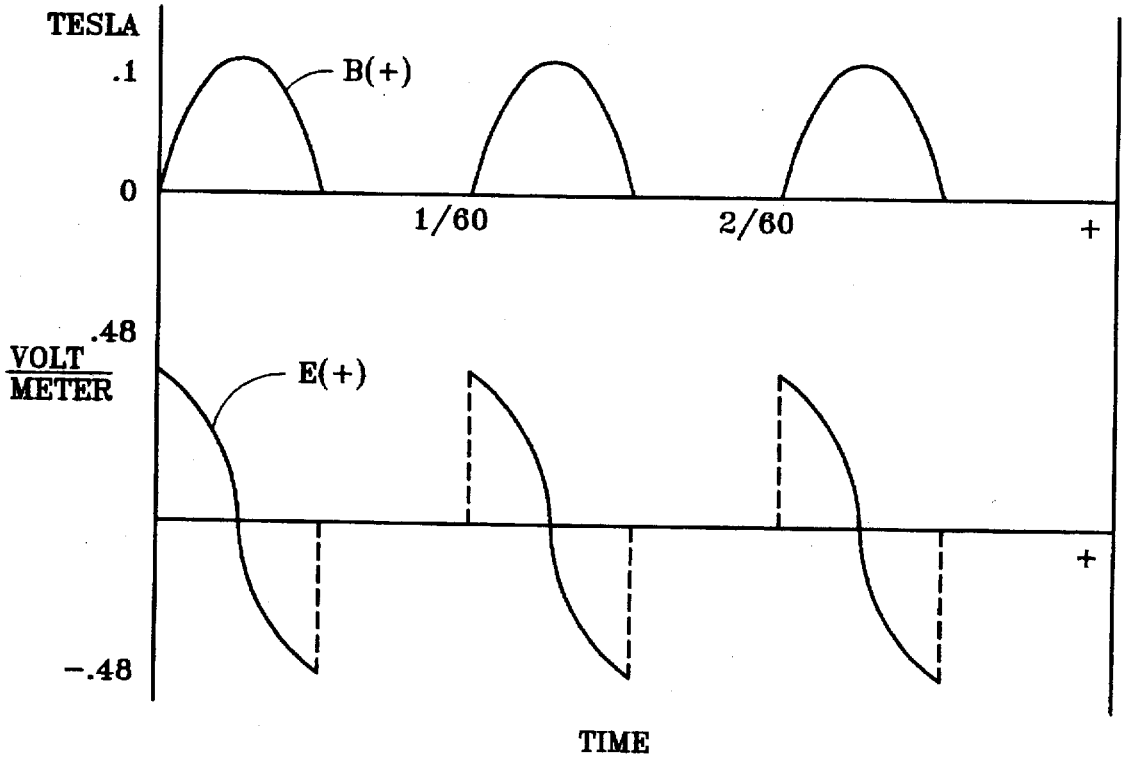
FIG. 5 is an illustration of the magnetic field waves and the electrical field waves associated with a half-wave rectified current as practiced by the present invention.
Figure 6:
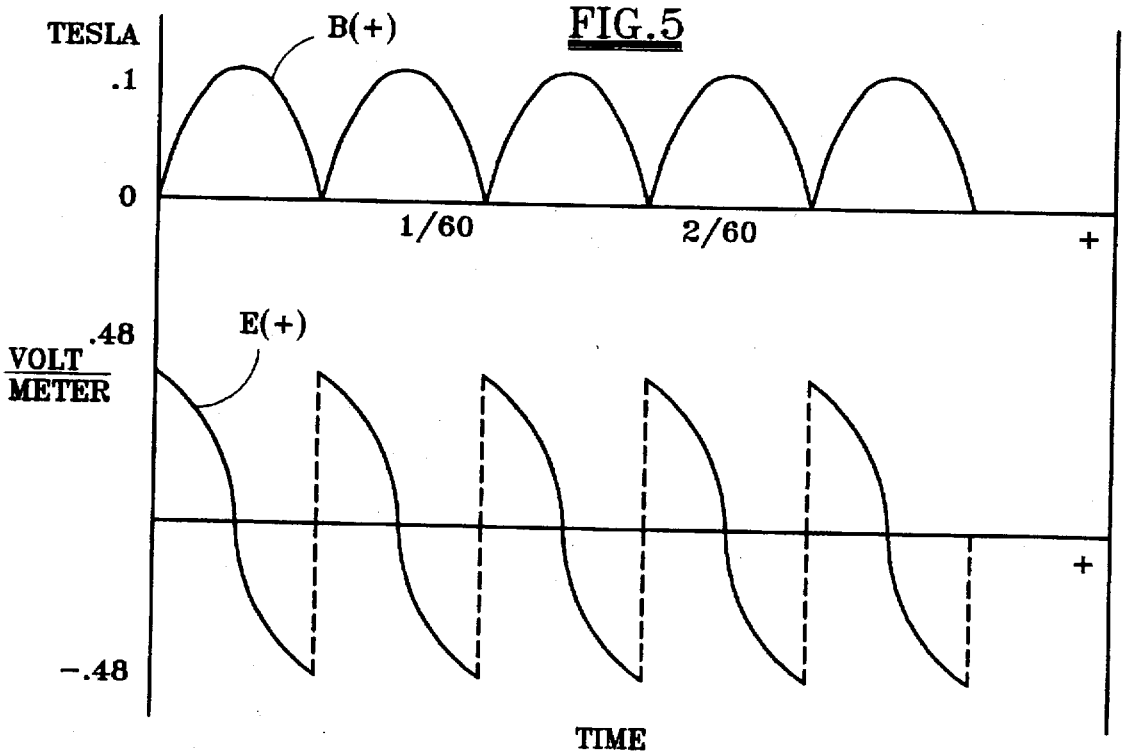
FIG. 6 illustrates a magnetic field wave and an electrical field wave for a full rectified current as practiced by the present invention.

A halfwave rectified current wave form for the magnetic field and the electric field, and also, a full wave rectified current are shown in FIGS. 5 and 6.

At the center of the conduit, the electric field will be zero and will increase in value proportionally to the radius. The induced current in the conduit decreases the maximum magnetic field that would be in the conduit. It can be appreciated that the current induced by the magnetic field will be desiccated or lost through the conductor cylindrical pipe of the electromagnetic fluid conditioning apparatus. In order to avoid this loss, the electromagnetic fluid conditioning apparatus is provided with an internal plastic coating that is an electrical insulator. The internal insulator maximizes the use of the electrical field inside the electromagnetic fluid conditioning apparatus induced by the magnetic field.

Figure 7:
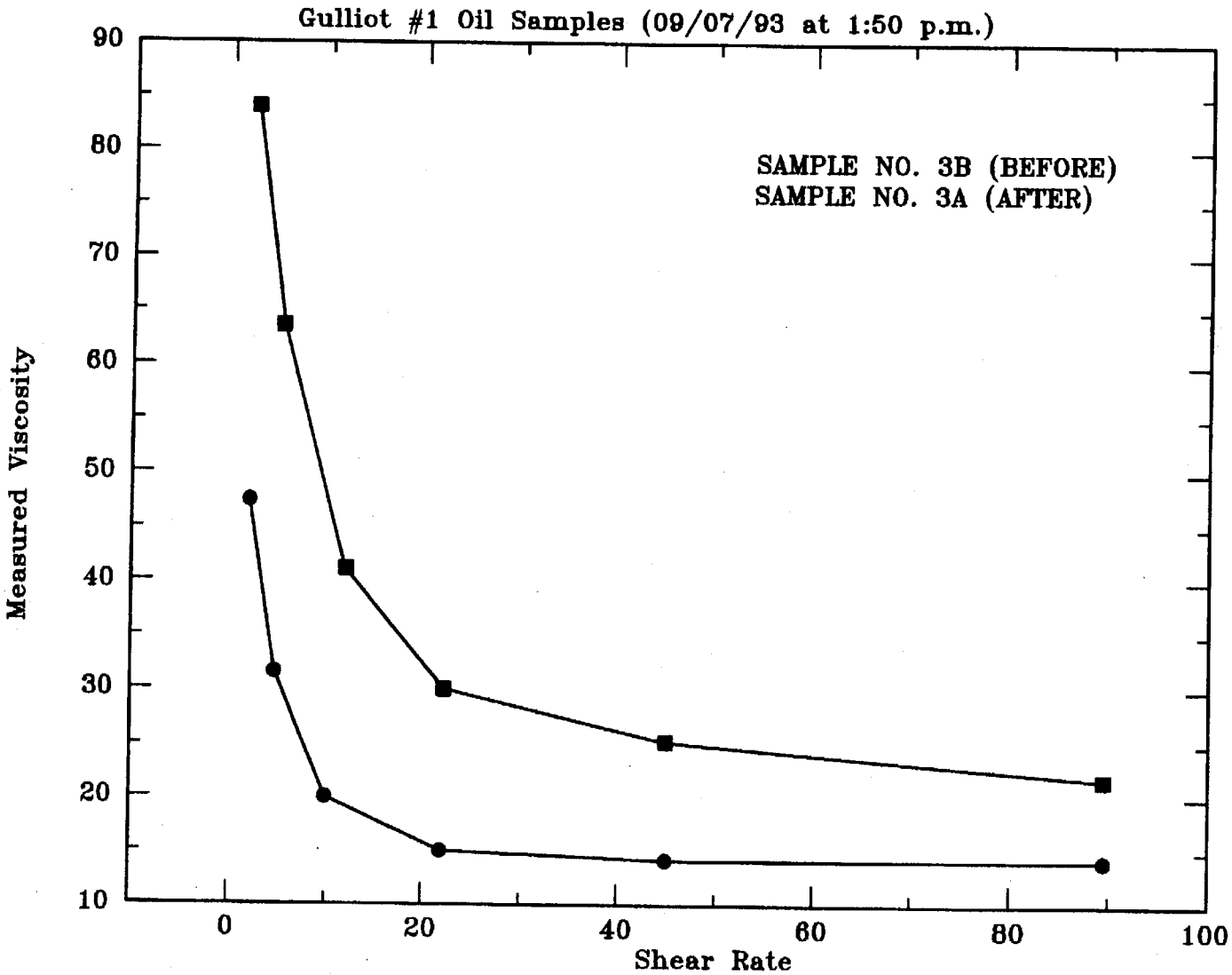
FIG. 7 is a plot illustrating the characteristic of the viscocity before using the apparatus or method of the present invention and after using the present invention, wherein the plot illustrates viscocity versus shear rate.

FIG. 7 illustrates the greatly enhanced physical property of viscosity associated with using the apparatus and method of the present invention. There is an inverse relationship between the viscocity and the temperature. When the temperature descreases the viscocity increases. Also, when the paraffin or asphaltine, within a fluid, go into the solid state and out of solution the viscosity increases. FIG. 7 illustrates a dramatic reduction of viscosity by practicing the present invention. Such a reduction in viscosity implies that the solid in the fluid has acquired a more fluidic characteristic and requires less frictional energy to be transported within the fluid. Indeed, the grave characteristics of the viscocity before treatment with the present invention and the greatly enhanced characteristics of the viscocity after treatment with the present invention implies that rheological characteristics of the fluid has changed.

Figure 8:
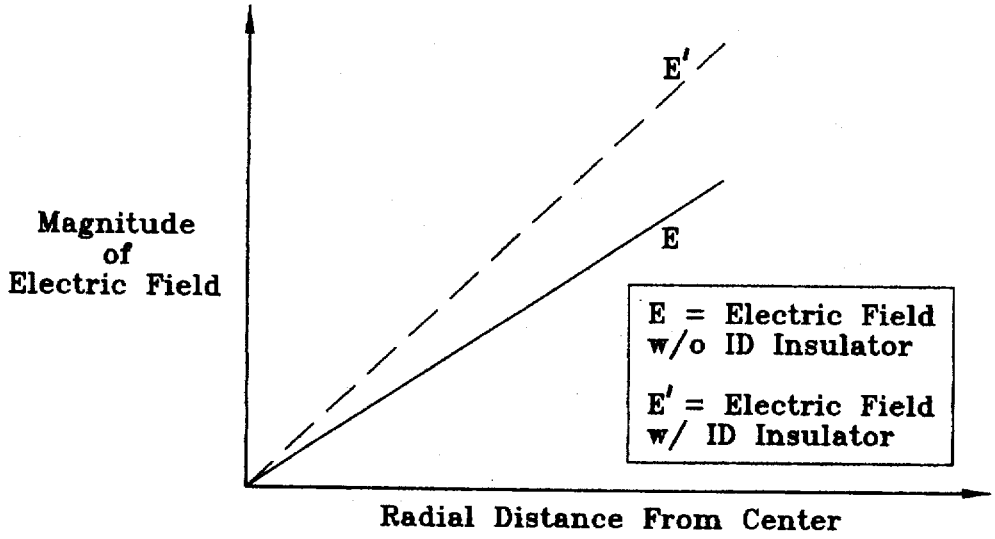
FIG. 8 is a plot of intensity versus distance from the center illustrating the intensity of the electric field with an inner insulator and without an inner insulator as practiced by the present invention.

FIG. 8 illustrates the distance from the center associated with the electric field with and without the inside diameter insulator associated with the present invention. The increased efficiency of the electric field associated with the present invention is provided, in part, at least, by using an insulator on the inside of the conduit through which the fluid flows. The increased efficiency of the electric field is due to the use of the electrical insulator inside the conduit diameter.

Figure 9:
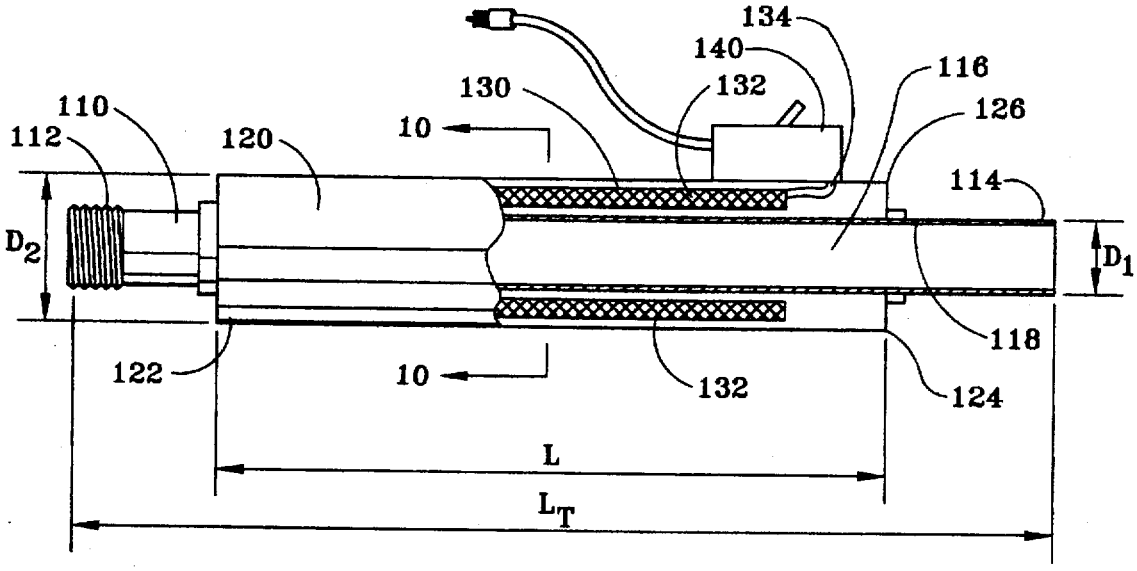
FIG. 9 illustrates a cut-away view of an embodiment of the present electromagnetic fluid conditioning apparatus of the present invention.

FIG. 9 illustrates a partial-cutaway of an embodiment of the apparatus of the present invention. FIG. 9 illustrates the electromagnetic fluid conditioning apparatus 100. The electromagnetic fluid conditioning apparatus 100 has as its basic components a non-magnetic conduit 110, a housing 120, a continuous winding 130 and an electrical assembly 140. The non-magnetic conduit 110 has a first end 112 and a second end 114. Also, between the first end 112 and the second end 114 of the non-magnetic conduit 110 is an unobstructed channel 116. The channel 116 has engaged on its surface an insulator 118.

The continuous winding 130 comprises multiple layers of wire 132. The wire 132 can be of varying gauges and conductances. The wire 132 is wrapped around the exterior of the conduit 110 so as to form the winding 130. The winding 130 has electrical connections 134. The electrical connections 134 engage the electrical assembly 140. The preferred wire specifications are provided in TABLE 1.

TABLE 1

| Size Wire (AWG) | #18 | #16 | #14 | #12 | #10 | #8 | #6 | #4 |
|---|---|---|---|---|---|---|---|---|
| Stranding | 16 | 16 | 16 | 16 | 16 | 16 | 16 | 16 |
| Voltage - VDC | 120 | 120 | 120 | 120 | 120 | 120 | 120 | 120 |
| Amperes - RMS | 2.08 | 2.08 | 2.08 | 2.08 | 2.08 | 2.08 | 2.08 | 2.08 |
| resistance/1000' | 7.95 | 4.99 | 3.14 | 1.98 | 1.24 | 0.778 | 0.491 | 0.308 |
| Length of Run - feet | 2200 | 2200 | 2200 | 2200 | 2200 | 2200 | 2200 | 2200 |
| Voltage Drop - VDC | 72.76 | 45.67 | 28.74 | 18.12 | 11.35 | 7.12 | 4.49 | 2.82 |
| Voltage Drop - % | 60.63 | 38.06 | 23.95 | 15.10 | 9.46 | 5.93 | 3.74 | 2.35 |

The electrical assembly 140 comprises a rectifier 142, a pulse generator 144 and a mode selector 146. The rectifier 142 provides that the current into the apparatus 100 is always direct current. The pulse generator 144 provides that the magnetic and electrical fields are pulsed at a specific frequency. The mode selector 146 provides that the mode can be in a fullwave mode or a halfwave mode.

The conduit 110 can be a cylinder, hexagon or any other geometrical shape. The ends 112, 114 can be connected to a flow system by thread connections or suitable flanges (welded or thread flange). The channel 116 of the conduit 110 has a full diameter, D1, disposed between the ends 112, 114. There are no restrictions to flow through the channel 116 other than the internal wall of the conduit 110. The internal wall of the conduit 110 is coated with insulation 118, such as, for example, plastic. The wire 132 is coiled with several turns to form a helical winding around the conduit 110. Preferably, the wire 132 is insulated. The wire 132 extends from one end 122 to the adjacent end 124. The power cable has an electrical plug for connections. The envelope 126 covers and protects the non-magnetic conduit 110 and the wire 132. The envelope 126 can be aluminum or stainless steel. The electrical assembly 140 contains an electrical rectifier and a pulse generator and a mode selector switch (1½ wave and full wave). The present invention can work in various modes, for example:

1. at 60 HZ frequency with half wave
2. at 120 HZ frequency with fur wave

The electrical assembly 140 is connected or disconnected to the aluminum or stainless envelope 126. The electrical assembly 140 with the selector switch is weather proof. The electrical assembly 140 is connected to an electrical source (for example, 115 volt and 60 Hz) or to a commercial voltage adapter or converter.

Figure 10:
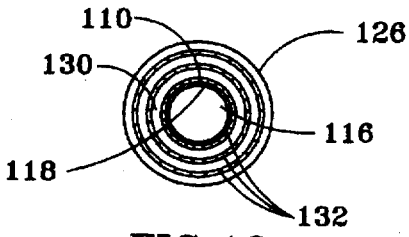
FIG. 10 illustrates a radial cross-section of the apparatus illustrated in FIG. 9 taken along the section line 10—10.

FIG. 10 is a cross-sectional view taken along the section 10—10 of FIG. 9. FIG. 10 illustrates the winding 130 and its associated wires 132. The winding 130 is contained within the envelope 126 and outside the conduit 110. The channel 116 is defined by the insulator 118 engaged with the inner surface of the conduit 110.

Figure 11:
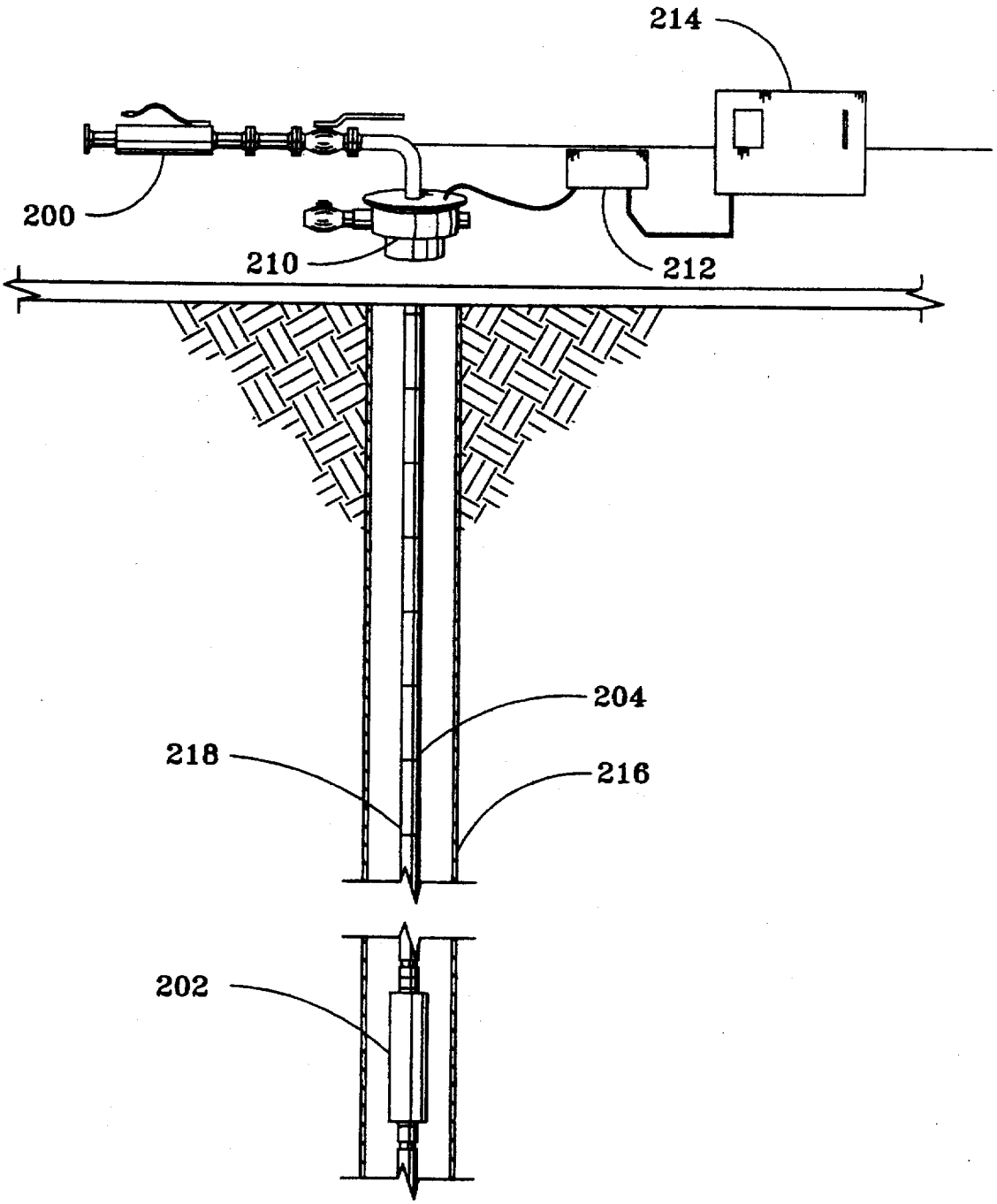
FIG. 11 is an illustration of the use of a surface apparatus and a donwhole apparatus as practiced by the present invention.
Figure 12:
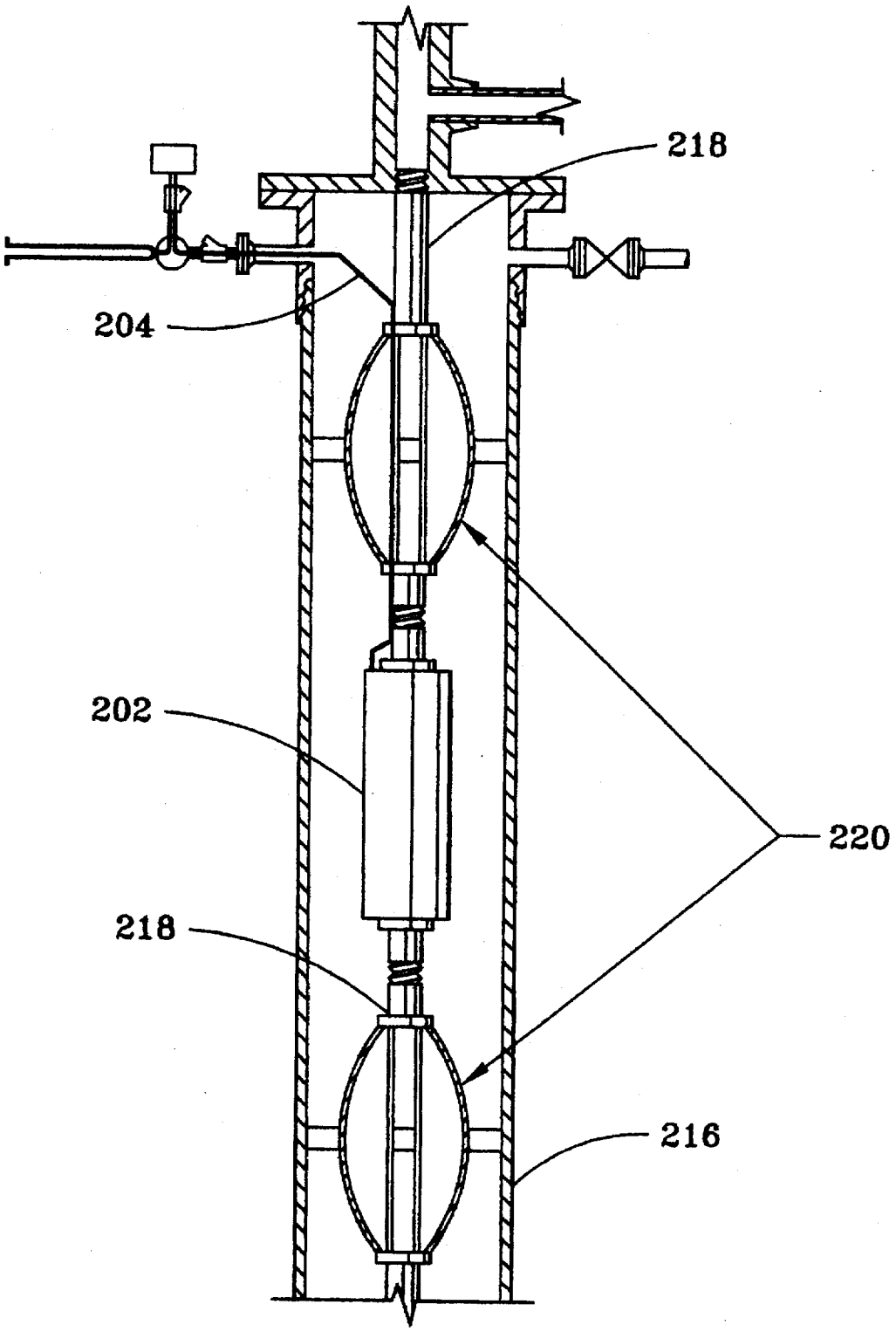
FIG. 12 is a cut-away view of a downhole apparatus as practiced by the present invention.
Figure 13:
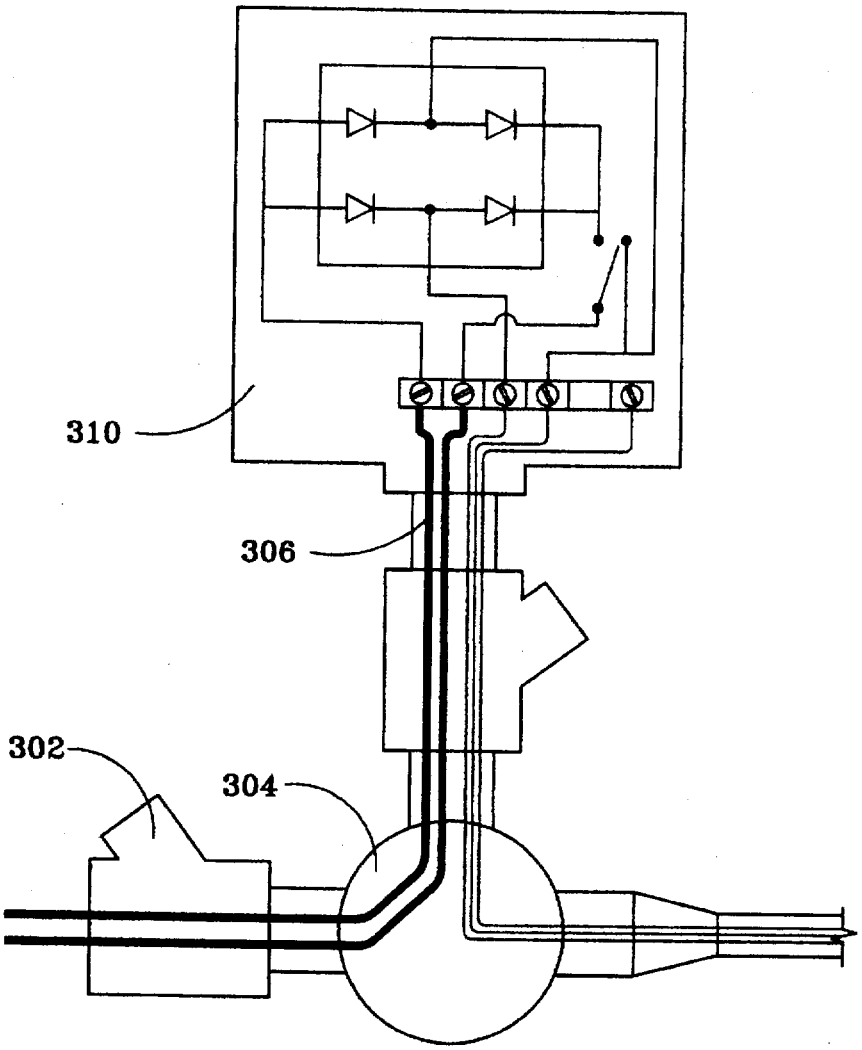
FIG. 13 is an exploded view of the electric service enclosure as illustrated in FIG. 12.

The apparatus of the present invention has two preferred embodiments first as a surface unit and second as a downhole unit. The surface unit is illustrated in FIGS. 9 and 10 and the downhole unit is illustrated in FIGS. 11–13. The principle of operation is the same for both units. The downhole unit is an integral part of the tubing string 218. The present invention provides no restriction to the flow of fluid.

FIG. 11 illustrates a prospective, cut-away view of an embodiment of the apparatus and method used in a downhole application and a surface application. With respect to the surface application, the electromagnetic fluid conditioning apparatus 200 is connected in a flow line associated with a wellhead 210. With respect to the downhole apparatus 202, the apparatus 202 is associated with a tubing strain 218 within a casing 216. The casing 216 is associated with the wellhead 210. The downhole apparatus 202 is in communication with electronic means via a power cable 204. The power cable 204 is associated with a junction box 212 and a switch box 214.

FIG. 12 is a cut-away, exploded view of the downhole unit 202 illustrated in FIG. 11. The electromagnetic fluid conditioning apparatus 202 is maintained in the center of the casing 216 using centralizers 220. The centralizers 220 are disposed on either side of the electromagnetic fluid conditioning apparatus 202. Thus, the tubing string 218 and the electromagnetic fluid conditioning apparatus 202 are maintained in a central location with respect to the casing 216 by using the centralizers 220. The centrializers 220 are optional. The power cable 204 provides power to the electromagnetic fluid conditioning apparatus 202 via an electrical enclosure in associated FIGs.

FIG. 13 is an illustration of one embodiment of the electrical fittings illustrated in FIG. 12 and associated with the power cable 204. The power cable 204 comes into a first fitting 302 that passes into a second fitting 304 via an electrical conduit. The power cable passes from the joint 304 through another fitting 306 into an enclosure 310. The enclosure 310 maintains the bridge rectifier circuit and associated switching devices.

Figure 14:
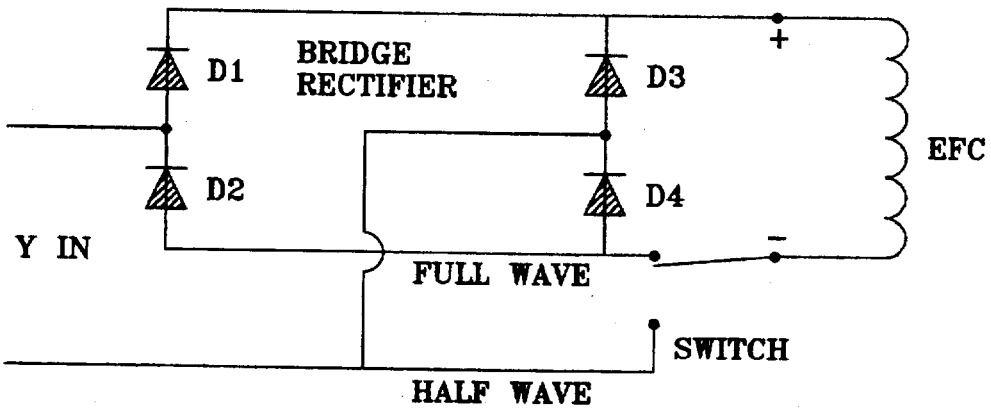
FIG. 14 is a schematic of a preferred bridge rectifier and dual mode switch as Used in practicing the present invention.

FIG. 14 illustrates one embodiment of the bridge rectifier and dual mode switch used with the present invention.

The advantages of the electromagnetic fluid conditioning (EFC) apparatus and method are better understood with respect to operating characteristics. The ratio of the winding length, L, and diameter, D1, is not limited to a specific EFC value or the neighborhood of specific fixed value. According to the designing mathematical equation (21) the winding length, L, is an important design parameter. The winding length, L, governs the magnetic intensity of the apparatus. The smaller the winding length, L, the higher the magnitude of the intensity of the magnetic field, B, and the higher the B field intensity the higher the magnitude of the induced electric field, E. The higher the intensity of the magnetic and electric fields, the higher the effectiveness to control paraffin and/or asphaltene deposition. Any unit limited to a specific L/D ratio for designing is totally inefficient in the majority of the field applications. A practical range of allocation will be:

$$0.1 \leqq \frac{L}{D} \leqq 10{,}000$$

The electromagnetic fluid conditioning apparatus and method operates in two primary modes, and more if necessary, to produce the most adequate electromagnetic field applicable to specific conditions. The electromagnetic fluid conditioning apparatus and method can use half cycle 60 Hz DC pulse or full cycle 120 Hz pulse current or other frequencies and modes. The pulsing frequency and the intensity of the high magnetic field and intensity of the induced electrical field are controllable for efficiency.

The electromagnetic fluid conditioning apparatus and method winding coil is protected by an aluminum or stainless steel case. The case allows high heat dissipation of the unit and better protection to from mishandling and the severity of the environment. The electromagnetic fluid conditioning apparatus is heavy duty built and weather proof. The aluminum or stainless steel case protection makes the manufacturing process cost effective and faster. There is no need to embed any part of the electromagnetic fluid conditioning apparatus for protection. Consequently repairing, of the apparatus is easy and quick. The electromagnetic fluid conditioning apparatus has a non-magnetic metallic protection for the winding of the coil with high heat dissipation capability.

Peripheral devices are exterior of the aluminum or stainless steel case and are easily attached or unattached for flexibility of application or substitution of any peripheral part. Thus, the present invention has great flexibility of application to specific situations. It is easy and cost effective to change defective peripheral parts. The manufacture is easier and faster without peripherals being incorporated permanently in the main body of the apparatus.

Using the above described mathematical model in combination with the discussed understanding of the mechanisms of paraffin or/and asphaltene deposition make the design of the present invention for specific application readily achievable.

The electromagnetic fluid conditioning apparatus and method of the present invention is not only applicable to control the deposition of paraffin and/or asphaltene, but is also applicable to any deposition of substances with molecules and/or aggregate in colloidal solution susceptible to the effect of a combined vibrating magnetic field and an electric field. The present invention is also, suitable for scale deposition control and other applications such as static control and the like.

The electromagnetic fluid conditioning apparatus and method of the present invention has a distinct advantage in comparison with any magnetic units based on magnetohydrodynamic principles. The present invention controls the intensity of the electric field output at a practical level. Any invention based on magnetohydrodynamics depends on restrictions to increase velocity of the fluid in the conduit and the conductivity of the fluid passing through a static magnet. Any restriction in the production piping section of a production system is detrimental to the production of an associated oil well.

The apparatus of the present invention is designed to work in two primary modes: (a) in a 60 Hz frequency with half-wave, and (b) in a 120 Hz frequency with full-wave. The EFC is designed to work with direct current. The alternating current is converted to DC by using a rectifier circuit. FIG. 14 is a schematic of the preferred circuit that sets the frequency and converts AC to DC. With the switch in the half-wave position the sinusoidal AC wave form enters the bridge rectifier. The resulting wave form leaves the rectifier and enters the coil. In the circuit illustrated in FIG. 14, the current cannot travel through D4 or D2. The current can only travel through D1 in one direction causing the only half of the input to be used. The current through D3 is always equal to the current through D1. With the switch in the full-wave position, the sinusoidal AC wave form enters the bridge rectifier. The resulting wave form leaves the rectifier and enters the coil. In this circuit when the input current is positive, it can travel through D1 into the positive side of the apparatus through D4 and out the negative side. When the current is negative, it can travel through D3 into the positive side of the apparatus through D2 and out the positive side. The bridge rectifier ensures that all of the current that enters the coil has the same polarity.

Experimental research and field experience has demonstrated that the electromagnetic fluid conditioning apparatus and method of the present invention has effect on the deposition of paraffin and/or asphaltene. The effect is produced by a combined effect of a magnetic field and the induced electrical field. Both the magnetic field and the electric field have to have sufficiently high intensity and high vibration to produce the effect of controlling paraffin and/or asphaltene as well as other substances susceptible to the present electromagnetic effect. Magnetic units with no electric field or significant electric field are not effective.

Additional advantages and modification will readily occur to those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

What is claimed is:

1. A method for the treatment of fluids or solutions comprising molecules which fluids are effected by electric fields or magnetic fields, such as, for example, paraffin, asphaltene and any other fluids similarly affected comprising the steps of:

(a) passing the fluid through a non-magnetic conduit having a central axis, (b) generating a magnetic field of sufficient intensity to effect the fluid, and given that the fluid has magnetic susceptibility, creating a ferro-magnetic fluid, (c) inducing an electric field in association with the magnetic field such that the magnetic field is parallel to the flow of fluid in the conduit and the induced electric field is orthogonal to the direction of the flow of fluid in the conduit, (d) vibrating the magnetic field and the electric field to a sufficient intensity so as to control the nucleation phenomena of the molecules such that aggregation is inhibited and the molecules remain in solution, (e) impressing the fluid with the combined effect of the electric field and the magnetic field such that the electric field is zero at the central axis of the conduit and increases proportionally therefrom for reducing or preventing sedimentation.

2. The method for the treatment of fluids or solutions as defined in claim 1 further comprising the step of insulating the conduit from direct contact with the electric field.

3. The method for the treatment of fluids or solutions as defined in claim 1 wherein the step of vibrating the magnetic field and the electric field comprises using a high frequency AC current.

4. The method for the treatment of fluids or solutions as defined in claim 1 wherein the step of vibrating the magnetic field and the electric field comprises using a pulsed DC current.

5. The method for the treatment of fluids or solutions as defined in claim 1 wherein the step of generating a magnetic field, B, of sufficient intensity to effect the fluid comprises calculating the intensity from $$B=\frac{\mu_o IN}{L}.$$

6. The method for the treatment of fluids or solutions as defined in claim 1 wherein the step of generating a magnetic field, B, of sufficient intensity to effect the fluid comprises generating a magnetic field greater than 50 Gausses.

7. An apparatus for the treatment of fluids or solutions comprising molecules which fluids are effected by electric fields or magnetic fields, such as, for example, paraffin, asphaltene and any other fluids similarly affected comprising (a) a non-magnetic conduit having a first end and a second end, said conduit defining an unobstructed passage between the first end and the second end for receiving and passing therethrough the fluid, (b) means for generating a magnetic field, and given that the fluid has magnetic susceptibility, the magnetic field creates a ferro-magnetic fluid, and further, such that an electric field is induced in association with the magnetic field such that the magnetic field is parallel to the flow of fluid in the conduit and the induced electric field is orthogonal to the direction of the flow of fluid in the conduit, (c) means for vibrating the magnetic field and the electric field to a sufficient intensity for controlling the nucleation phenomena of the molecules such that aggregation is inhibited and the molecules remain in solution, such that when the vibrating fields are impressed upon the fluid a combined effect of the fields results such that the electric field is zero at the central axis of the conduit and increases proportionally therefrom for reducing or preventing sedimentation.

8. The apparatus for the treatment of fluids or solutions as defined in claim 7 wherein said means for generating a magnetic field comprises a coiled wire operationally associated with said conduit.

9. The apparatus for the treatment of fluids or solutions as defined in claim 8 wherein said coiled wire is insulated with respect to each turn of said coil.

10. The apparatus for the treatment of fluids or solutions as defined in claim 8 wherein said coiled wire has a winding length, L, and a diameter, D, such $0.1 \leqq L/D < 10{,}000$.

11. The apparatus for the treatment of fluids or solutions as defined in claim 8 further comprising a non-magnetic housing for encapsulating said coiled wire and an adjacent portion of said housing.

12. The apparatus for the treatment of fluids or solutions as defined in claim 7 wherein said means for generating a magnetic field, B, of sufficient intensity to effect the fluid comprises calculating the intensity from $$B=\frac{\mu_o IN}{L}.$$

13. The apparatus for the treatment of fluids or solutions as defined in claim 7 wherein said means for generating a magnetic field, B, of sufficient intensity to effect the fluid generates a magnetic field greater than 100 Gausses.

14. The apparatus for the treatment of fluids or solutions as defined in claim 7 further comprising a insulator for preventing the direct contact of the fluid with said conduit.

15. The apparatus for the treatment of fluids or solutions as defined in claim 7 wherein said means for vibrating the magnetic field and the electric field comprises using a high frequency AC current.

16. The apparatus for the treatment of fluids or solutions as defined in claim 7 wherein said means for vibrating the magnetic field and the electric field comprises using a pulsed DC current.

* * * * *